US005984554A

United States Patent [19]

Bouix

[11] Patent Number: 5,984,554

[45] **Date of Patent: *Nov. 16, 1999**

[54] AIRTIGHT COSMETIC CASE WITH BELLOWS

[75] Inventor: Herve F. Bouix, New York, N.Y.

[73] Assignee: Color Access, Inc., Melville, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/955,202

[22] Filed: Oct. 21, 1997

[51] Int. Cl.[6] ..... A45D 40/00

[52] U.S. Cl. ..... 401/98; 401/78; 401/202; 401/247; 206/385

[58] Field of Search ..... 401/78, 98, 247, 401/258, 153, 202; 206/385

[56] References Cited

U.S. PATENT DOCUMENTS

| | | | |
|---|---|---|---|
| 2,588,829 | 3/1952 | Greist | 401/153 |
| 4,086,011 | 4/1978 | Kuparinen | 401/258 |
| 5,186,563 | 2/1993 | Gebhard et al. | 401/153 |
| 5,197,814 | 3/1993 | Lombardi et al. . | |
| 5,234,275 | 8/1993 | Gueret | 401/78 |
| 5,342,134 | 8/1994 | Lombardi et al. . | |
| 5,533,823 | 7/1996 | Pierpoint et al. | 401/98 |

FOREIGN PATENT DOCUMENTS

| | | | |
|---|---|---|---|
| 1419530 | 10/1965 | France | 401/247 |

OTHER PUBLICATIONS

Patent Abstracts of Japan, vol. 98, No. 2, Jan. 30, 1998; & JP,A,09–267061 (Shiseido Co Ltd), Oct. 14, 1997.

*Primary Examiner*—Steven A. Bratlie
*Attorney, Agent, or Firm*—Kenyon & Kenyon

[57] ABSTRACT

The present invention is an airtight case comprising a base for receiving a stick-type product, a hollow cap, and a hollow plug sleeve inserted within the cap. The plug sleeve has an open end and a closed end, the closed end being a flexible bellows.

This case is useful in reducing the adverse effects caused by the pressure build-up associated with sealing or airtight cases. When the cap of the present invention is placed on the base of the case the bellows expands in response to the compressing of the air located within the inner chamber of the case, thus preventing the cap from being pulled away from the base. Also, when the cap is removed, the bellows contracts and prevents the product from being pulled out of the base.

10 Claims, 3 Drawing Sheets

AIRTIGHT COSMETIC CASE WITH BELLOWS

FIELD OF THE INVENTION

The present invention relates to a sealing or airtight case for stick products that aids in the release of internal pressure formed when the cap is placed on, and removed, from the case.

BACKGROUND OF THE INVENTION

It is desirable to have stick-type products that contain a volatile solvent because the volatile solvent provides for a better "feel" of the product when applied to the skin, and allows the product to dry or set quickly. The problem encountered with these types of formulations is that they readily lose the volatile solvent contained within their composition due to evaporation from the product.

The loss of a volatile solvent from a stick-type product can adversely affect the physical properties of the product as well as reduce the amount of volatile delivery. Even when not stored above room temperature, it has been noted that there is loss of the volatile solvent over time.

Prior art cases have tried to remedy this problem by providing a sealed case (see U.S. Pat. Nos. 5,197,814 and 5,342,134). This case provided for the insertion of a flexible sleeve into the cover of the case. When the cover is placed on the base of the case the flexible sleeve makes contact with an outer wall of the base and effectively seals the case and its contents from volatile loss. The flexibility of the sleeve, as described in this invention, is for the purpose of making a seal between the base of the case and the cover, whereby the sleeve flexes around any minor defects on the surface of the base and makes a seal.

The problem with these types of cases is that, although the case does effectively create a seal between the internal chamber and the external environment, a pressure build-up is experienced. This build-up of pressure is created through the compression of the air contained within the case when the cover is applied.

This compression of the air in the case creates a number of unappealing effects. First, when the cover is applied the compression of the air causes a back-pressure which pushes the cover away from the base. This creates a gap between the cover and the base which is not aesthetically appealing and which reduces the effectiveness of the seal between the base and the cover. Modifications can be made to eliminate this problem, for example, reducing the internal diameter of the cover to create a tighter fit between the cover and the base. This, in turn, makes the cover more difficult to remove from the base, which is unacceptable to consumers.

The tighter fit of the cover eliminates the problem of the back-pressure moving the cover away from the base, but in addition to the greater force required to remove the cover, additional drawbacks are encountered. With the cover in place, the pressure build-up within the internal chamber of the case will slowly dissipate through micro-leaks and equilibrate to that of the external environment. This is not an immediate occurrence. The cases will be filled, stored in a warehouse, and then shipped to the counter for consumer purchase. Dissipation of the internal pressure will occur over the time it takes the filled case to reach the consumer, which can take months.

With the internal pressure equal to that of the external environment, removal of the cover causes a depressurizing of the internal chamber. This creates a suction effect which will "pull" on the product and the internal components of the case. This suction will cause the product to either dislodge from the holder, or fracture, thus making the product unusable by the consumer.

This invention provides a case for a volatile solvent-containing stick-type product that aids in preventing the loss of the volatile solvent from the stick-type product.

This invention also provides a case that aids in preventing the undesirable effects associated with pressure build-up and dissipation within sealed cases.

This invention further provides a case for a volatile solvent-containing stick-type product wherein most components of the existing standard cases can still be employed thereby minimizing package re-tooling costs.

Further, this invention provides a case for a volatile solvent-containing stick-type product that prevents the loss of the volatile solvent from the stick-type product while at the same time being a relatively simple device that avoids interference with the package aesthetics.

SUMMARY OF THE INVENTION

The present invention is an airtight case comprising a base for receiving a stick-type product, a hollow cap, and a hollow plug sleeve inserted within the cap. The plug sleeve has an open end and a closed end, the closed end being a flexible bellows.

This case is useful in reducing the adverse effects caused by the pressure build-up associated with sealing or airtight cases. When the cap of the present invention is placed on the base of the case the bellows expands in response to the compressing of the air located within the inner chamber of the case, thus preventing the cap from being pulled away from the base. Also, when the cap is removed, the bellows contracts and prevents the product from being pulled out of the base.

BRIEF DESCRIPTION OF THE DRAWING

Further objects, features and drawings of the present invention will better be understood in light of the embodiment examples which are discussed below with the aid of a drawing wherein.

DETAILED DESCRIPTION OF THE INVENTION

A system has been devised which aids in reducing the adverse effects of pressure build-up within a sealing or airtight case when the cap is placed on the case. These sealing or airtight cases are used to prevent the loss of a volatile solvent from a volatile solvent-containing stick product. A "volatile solvent" is any liquid product that possesses a substantial or significant vapor pressure at or around ambient temperature (such as water, volatile oils, volatile silicones, and volatile alcohols).

Figure 1A:
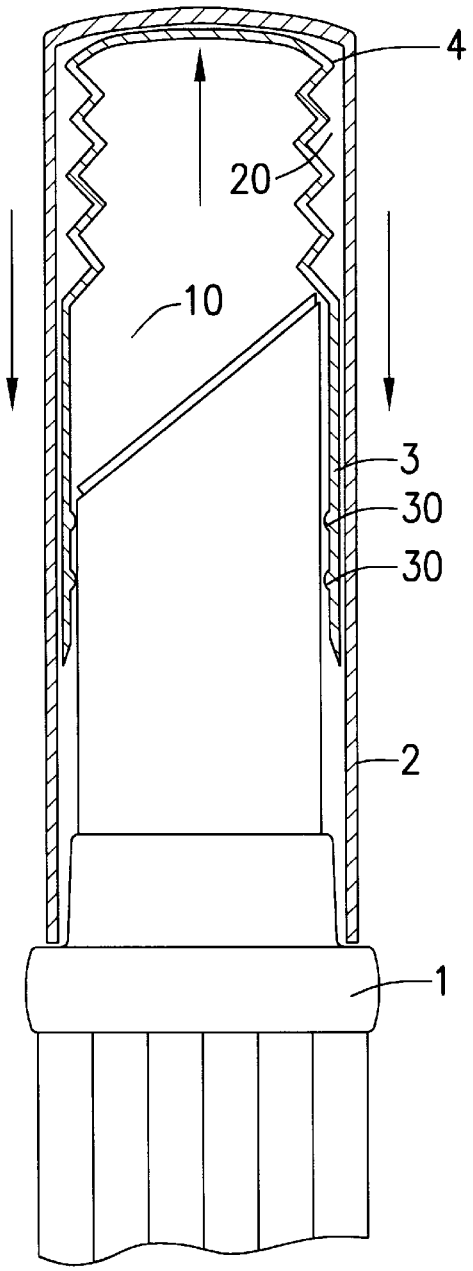
FIGS. 1A and 1B are cross-sectional views showing the operation of the cap of the present invention.

As seen in FIG. 1A, this invention is a case which comprises a base 1, a hollow cap 2 fitting over base 1, and a flexible plug sleeve 3 having a bellows 4 inserted within hollow cap 2. This invention can be configured for use with any lipstick case, deodorant case, or any other case that houses a stick product. Adaptation of the cases can be achieved through simple modifications whereby a flexible sleeve having a bellows is secured within a hollow cap.

The base 1 and the hollow cap 2 of the present invention are constructed of relatively hard materials such as polypropylene, ABS (acrylonitrile-butadiene-styrene), SAN (styrene-acrylonitrile), or combinations of ABS with SAN. Metallic material may also be used for the base and cap. Brass or chrome plated metal are particularly preferred.

Figure 1B:
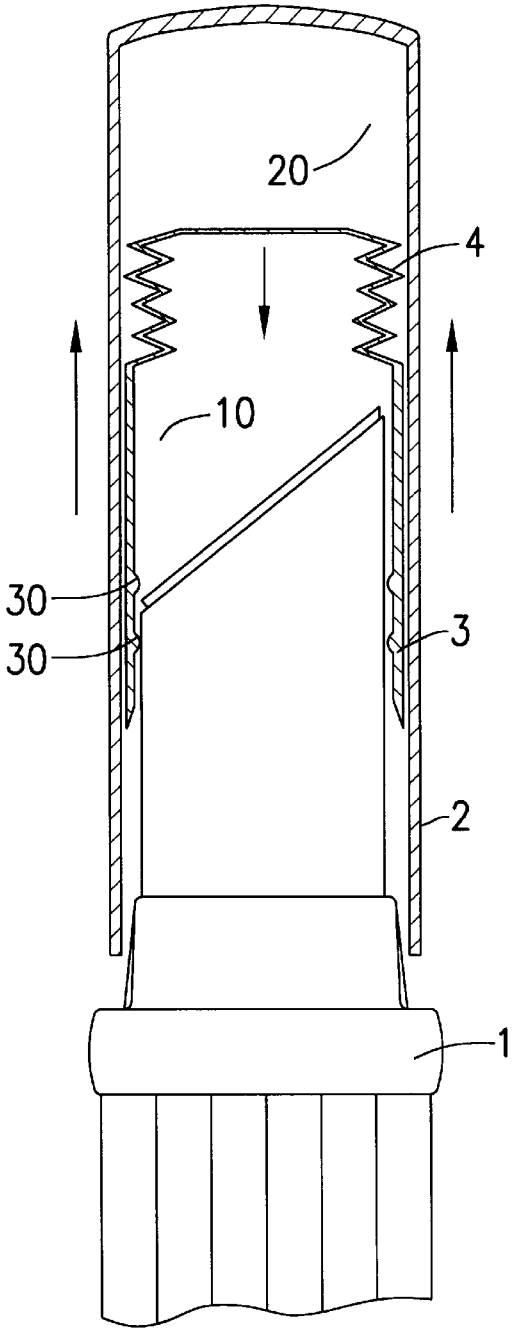
Figure 2:
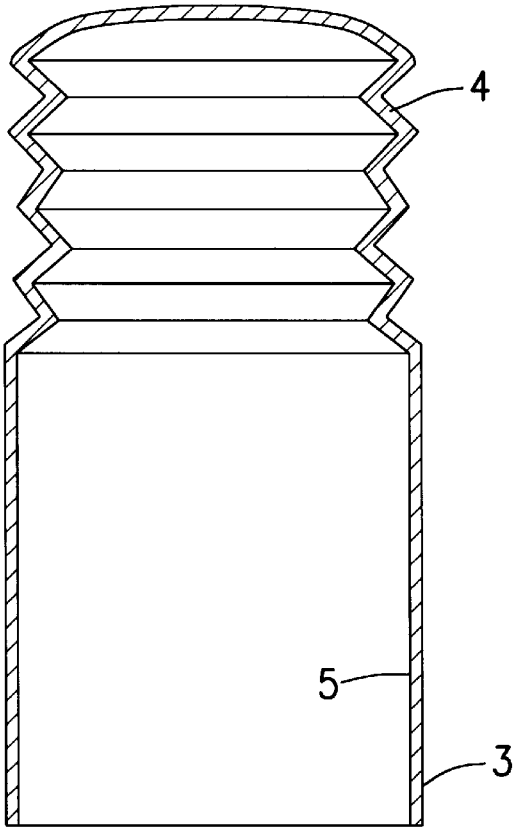
FIG. 2 is a cross-sectional view of a plug sleeve having a smooth inner wall.

Tightly fitting within the hollow cap is a flexible plug sleeve 3, as seen in FIG. 2. According to the first embodiment of this invention, plug sleeve 3 has a smooth inner wall 5 and a bellows 4 at the closed end. Preferably, plug sleeve 3 is dimensioned so as to extend at least half way down the length of cap 2, as seen in FIGS. 1A and 1B. The smooth inner wall 5 of plug sleeve 3 is used as a sealing surface. Inner wall 5 contacts base 1 and forms a seal between internal chamber 10 of the case and the external environment (see FIGS. 1A and 1B).

Preferably, bellows 4 at the closed end of plug sleeve 3 is an integral part of plug sleeve 3 (i.e., the same material). Bellows 4 is shaped and formed so as to be able to expand and contract when the cap is placed on and removed from base 1. This action can be seen in FIGS. 1A and 1B. In a preferred embodiment, bellows 4 is in the shape of an accordion and has a smaller diameter than that of plug sleeve 3.

An important feature of the present invention is that plug sleeve 3 is formed of a material which can easily be molded in the form of a bellows 4, and is more flexible than the material forming cap 2. First, flexibility is needed in order to allow plug sleeve 3 to elastically engage base 1 of the of the case, thereby making a seal. Second, flexibility is required so that bellows 4 will be able to expand and contract when exposed to pressure. Plastic materials and the like are suitable for use with the present invention. Preferred materials are polyethylene, polypropylene, polyethylene terephthalate, and elastomers. In a most preferred embodiment low density polyethylene is used. The dimensions required to enable bellows 4 to expand and contract will be dependent on the material chosen for plug sleeve 3.

The manufacturing of plug sleeve 3 can be accomplished by any number of conventional plastic molding methods, which are known in the art. One such method of manufacture is blow molding. Other methods include injection molding, injection-blow molding, dipping processes, and the like, the choice depending on the chosen material.

Placement of plug sleeve 3 within cap 2 is important. When assembling the case, plug sleeve 3 is positioned within cap 2 so that bellows 4, at its maximum point of expansion, will not reach the closed end of cap 2. Plug sleeve 3 also needs to be positioned so that bellows 4 will not contact the product during expansion or contraction.

Figure 3:
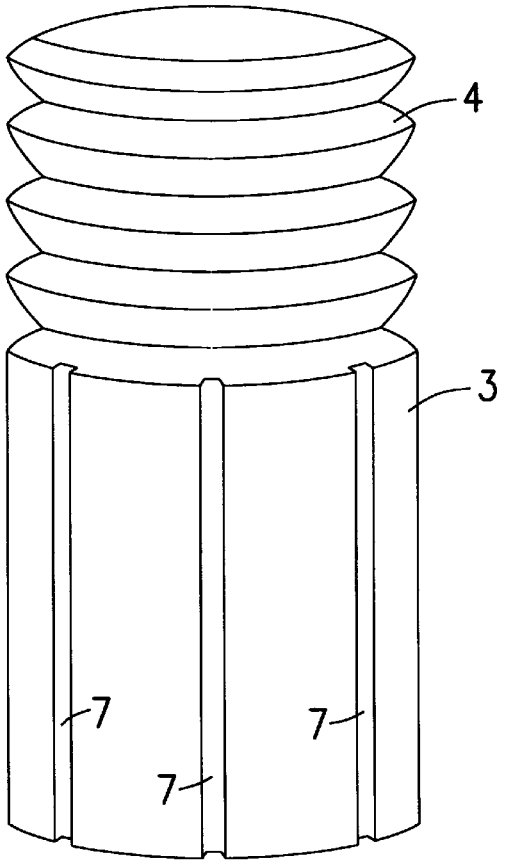
FIG. 3 is a side view of a plug sleeve with grooves in the outer wall.

When cap 2 and plug sleeve 3 of the present invention are placed on base 1 of a case, inner wall 5 of plug sleeve 3 elastically engages base 1 and makes a seal. With this sealing of the case, the air in space 20 between the inner wall of cap 2 and plug sleeve 3 is compressed and pushes at plug sleeve 3, causing bellows 4 to expand. The expansion of bellows 4 will cause the air in space 20 between cap 2 and plug sleeve 3 to compress, thus creating a back-pressure that will push bellows 4 to its original position. This is particularly so if the inner wall of cap 2 and the outer wall of plug sleeve 3 are smooth. Therefore, to alleviate this pressure between cap 2 and plug sleeve 3, one or more longitudinal grooves 7 along the external wall of plug sleeve 3, or along the inner wall of cap 2, or both, are provided (see FIG. 3). Longitudinal grooves 7 are positioned in cap 2 or plug sleeve 3 so that each groove 7 will extend from bellows 4 to the open end of plug sleeve 3. This will form a channel which will allow the air 20 trapped between cap 2 and plug sleeve 3 to escape to the external environment.

If, however, cap 2 is fluted or ribbed, groove 7 will not be needed. This is because the flutes or ribs will create a natural channel between bellows 4 and the inner wall of cap 2, thus allowing the air 20 to flow easily to the external environment.

Figure 4:
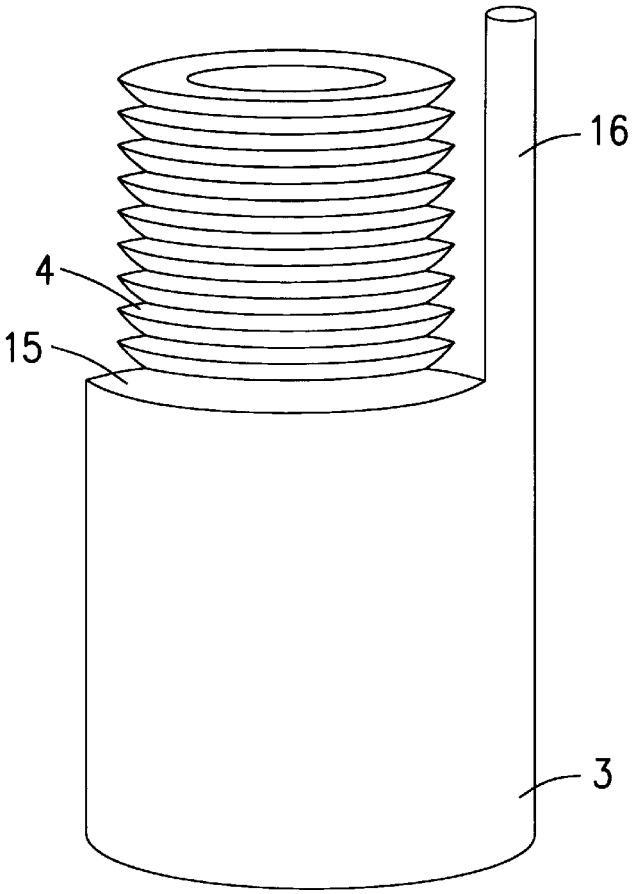
FIG. 4 is a side view of a plug sleeve having a post.

A second embodiment of the present invention, as seen in FIG. 4, employs a plug sleeve 3 having a slightly different configuration than that of the first embodiment. The second embodiment has the bellows 4 offset or narrower than plug sleeve 3. This narrower or offset configuration will provide a ledge 15. Provided on ledge 15 are one or more posts 16, which extend beyond the expanded length of bellows 4. Post 16, like bellows 4, is part of plug sleeve 3 and is formed during the molding process.

Post 16 is provided for the positioning of plug sleeve 3 within cap 2 during the assembly process. Since post 16 extends past the expanded bellows 4, post 16 will contact the closed end of cap 2 before bellows 4. This will allow plug sleeve 3 to be inserted to a point where bellows 4, at its maximum point of expansion, will not contact the closed end of cap 2.

Figure 5:
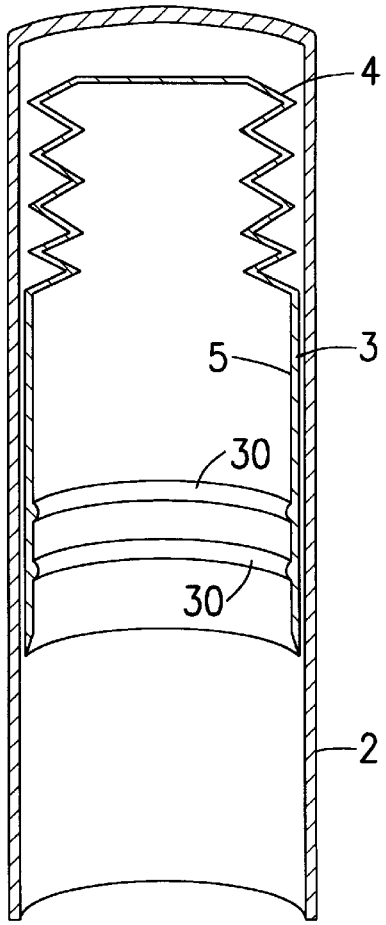
FIG. 5 is a cross-sectional view of a plug sleeve having sealing rings disposed on the inner wall.

In a further embodiment, one or more sealing rings 30 are positioned on inner wall 5 of plug sleeve 3, between the open and closed ends (see FIGS. 1A, 1B, and 5). Sealing ring 30 is fashioned as a circumferentially inwardly projecting ledge that is molded as part of plug sleeve 3. Sealing ring 30 functions in place of the sealing surface of the smooth inner wall 5 of plug sleeve 3. The use of a sealing ring 30 becomes important when aesthetic considerations of the case make sealing at the base very difficult. The use of a sealing ring 30 allows the case to be sealed with the same airtightness as the smooth inner wall 5, the difference being the location of the seal.

The foregoing descriptions illustrate selective embodiments of the present invention. In light thereof, various modifications will be suggested to one skilled in the art, all of which are within the scope and spirit of this invention.

What is claimed is:

1. An airtight cosmetic case comprising:

a base having a stick product received therein;

a hollow cap having an inner wall and an outer wall; and a hollow plug sleeve inserted within the cap, the plug sleeve having an open end, a closed end, an inner wall, and an outer wall, the closed end being a flexible bellows, the inner wall of the plug sleeve sealing about the base and the bellows expanding when the cap is placed on the base and retracting when the cap is removed from the base, said expanding and retracting not occurring by virtue of contact between the bellows and the stick product or the case.

2. A case according to claim 1, wherein the stick product is a lipstick, lip balm, sunscreen, or deodorant.

3. A case according to claim 1, wherein the plug sleeve is composed of a plastic material.

4. A case according to claim 3, wherein the plug sleeve is composed of polyethylene.

5. A case according to claim 3, wherein the plug sleeve is composed of low density polyethylene.

6. A case according to claim 1, wherein the plug sleeve has a smooth inner wall.

7. A case according to claim 1, wherein one or more sealing rings are positioned on the inner wall of the plug sleeve between the open end and closed end.

8. A case according to claim 1, wherein one or more longitudinal grooves are present on the outer wall of the plug sleeve, the grooves being of a length sufficient to extend from the bellows to the open end of the plug sleeve.

9. A case according to claim 1, wherein one or more longitudinal grooves are present on the inner wall of the cap, the grooves being of a length sufficient to extend from the bellows to the open end of the plug sleeve.

10. A case according to claim 1, wherein a ledge is provided by offsetting or narrowing of the flexible bellows portion of the plug sleeve, wherein the ledge has one or more posts which extend longitudinally beyond the expanded length of the bellows.

* * * * *